US009849698B2

(12) United States Patent
Obara

(10) Patent No.: US 9,849,698 B2
(45) Date of Patent: Dec. 26, 2017

(54) LABEL PRINTER

(71) Applicant: SATO HOLDINGS KABUSHIKI KAISHA, Tokyo (JP)

(72) Inventor: Takeshi Obara, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/312,284

(22) PCT Filed: Apr. 8, 2015

(86) PCT No.: PCT/JP2015/060951
§ 371 (c)(1),
(2) Date: Nov. 18, 2016

(87) PCT Pub. No.: WO2015/198681
PCT Pub. Date: Dec. 30, 2015

(65) Prior Publication Data

US 2017/0080725 A1 Mar. 23, 2017

(30) Foreign Application Priority Data

Jun. 25, 2014 (JP) ..... 2014-130331
Nov. 28, 2014 (JP) ..... 2014-241437

(51) Int. Cl.
*B41J 11/04* (2006.01)
*B41J 15/04* (2006.01)
(Continued)

(52) U.S. Cl.
CPC ..... *B41J 11/04* (2013.01); *B41J 3/4075* (2013.01); *B41J 15/04* (2013.01); *B41J 29/02* (2013.01);
(Continued)

(58) Field of Classification Search
CPC ..... B41J 13/0009; B41J 13/00; B41J 15/00; B41J 15/046; B41J 15/044; B41J 15/04; B41J 11/04; B41J 3/4075
See application file for complete search history.

(56) References Cited

U.S. PATENT DOCUMENTS 5,913,626 A 6/1999 Ishida et al.

FOREIGN PATENT DOCUMENTS

JP 02-014173 A 1/1990
JP 02-171267 A 7/1990
(Continued)

OTHER PUBLICATIONS

Mobile Printer Lapin Series Catalog, Sato Holidings Corporation, Jan. 2005, 8 pages.
(Continued)

*Primary Examiner* — Kristal Feggins
(74) *Attorney, Agent, or Firm* — Lee & Morse P.C.

(57) ABSTRACT

A separation unit (10) of a label printer includes a metal nip roller shaft (11), a resin nip roller (12) disposed at a center part of the nip roller shaft and is supported so as to be rotatable around the nip roller shaft, and resin supporters (13) that support both ends of the nip roller shaft. The separation unit (10) is attached to the body case (2) to be relatively movable between the normal ejection position and the separation ejection position. Each of the pair of supporters has a part protruding toward the nip roller, and this part is a roller holder (13*d*) to insert an end of the nip roller shaft. The roller holder and the supporter are integrally formed for enhanced strength of the supporter.

18 Claims, 15 Drawing Sheets

(51) Int. Cl.

| | |
|---|---|
| ***B65H 41/00*** | (2006.01) |
| ***B41J 3/407*** | (2006.01) |
| ***B41J 29/02*** | (2006.01) |

(52) U.S. Cl.
CPC ..... *B65H 41/00* (2013.01); *B65H 2401/231* (2013.01); *B65H 2701/192* (2013.01)

(56) References Cited

FOREIGN PATENT DOCUMENTS

| | | | |
|---|---|---|---|
| JP | 07-125356 | A | 5/1995 |
| JP | 11-029125 | A | 2/1999 |
| JP | 2000-125059 | A | 4/2000 |
| JP | 2001-096839 | A | 4/2001 |
| JP | 2001-113785 | A | 4/2001 |
| JP | 2003-160117 | A | 6/2003 |
| JP | 2005-193526 | A | 7/2005 |
| JP | 2007-185774 | | 7/2007 |
| JP | 2008-149475 | A | 7/2008 |
| JP | 2013-166631 | A | 8/2013 |
| JP | 2013-216470 | A | 10/2013 |
| JP | 2014-080199 | A | 5/2014 |

OTHER PUBLICATIONS

Written Patent Opposition and English translation, Aug. 26, 2016, 74 pages.
Written Notification of Revocation Reasons and English Translation, Dispatch No. 028422, dated Apr. 12, 2017, Opposition No. 2016-700592, U.S. Pat. No. 5,839,520, dated Mar. 31, 2017.
Written Observation Record and English Translation, Opposition No. 2016-700592, dated Feb. 23, 2017.

LABEL PRINTER

TECHNICAL FIELD

The present invention relates to a label printer configured to print information, such as letters, symbols, graphics or barcodes on a label temporarily adhering to a mount and having a separation ejection function to separate the label from the mount and eject the same.

BACKGROUND ART

A label printer includes a thermal head and a platen roller. For example, the label printer rotates the platen roller while pinching one end in the longitudinal direction of a label continuous body wound into a roll between the thermal head and the platen roller, and releases the label continuous body from the roll to feed the label continuous body in a sheet form. During the feeding, the thermal head in the label printer prints desired information on each of a plurality of labels temporarily adhering to a long strip of mount of the label continuous body.

There may be two types of ejection modes for such a label printer, including a normal ejection mode and a separation ejection mode. The normal ejection mode is to eject labels while leaving the labels temporarily adhering to a mount. The separation ejection mode is to separate labels from a mount using a separation bar and a nip roller and then eject the same. The separation bar is disposed in the vicinity of the platen roller as feeding means of the label continuous body.

Japanese laid-open patent publication H11-029125 discloses a technique to prevent sagging of a mount at the separation bar. The printer includes an upstream-side holder to press a label continuous body against the separation bar upstream from the separation bar, and a downstream-side holder to press the mount against the separation bar downstream from the separation bar.

SUMMARY OF THE INVENTION

Technical Problem

Among such label printers having a separation ejection function, there is a portable label printer hanging from a belt on the waist of an operator for use when the operator is standing during the operation, for example. In order to respond to the needs for compact and light-weighted printers, such a portable label printer includes many components of the separation mechanism that are molded products of synthetic resin. Another label printer of a standalone type also includes many components of the separation mechanism that are molded products of synthetic resin from the viewpoint of reduction in the cost of the components.

There is a portable label printer with which normal-ejection mode printing and separation-ejection mode printing can be switched, for example. Such a portable label printer is configured so that the separation mechanism moves in the body case of the printer at every switching between the normal ejection and the separation ejection. Such a portable label printer includes many components of the separation mechanism that are molded products of synthetic resin. Therefore, it is important to prevent deterioration in mechanical strength of such synthetic resin components.

In view of the technical background as described above, the present invention aims to provide the technique of improving mechanical strength of a separation mechanism of a label printer.

Solution to Problem

A label printer according to a first aspect of the present invention, includes: a housing including an opening; an opening and closing cover attached to the housing so as to open and close the housing; a feed roller rotatably supported on the opening and closing cover, the feed roller being configured to feed a print medium; a separation bar supported on the opening and closing cover and disposed in the vicinity of the feed roller; a print head disposed in the housing, the print head being disposed so as to be opposing the feed roller when the opening and closing cover is closed, the print head being configured to print on the print medium; and a separation mechanism disposed adjacent to the feed roller when printing on the print medium. The separation mechanism includes: a pair of supporters each including a roller holder; a nip roller shaft supported by the roller holders of the pair of supporters; and a nip roller supported on the nip roller shaft so as to be rotatable, and each of the pair of supporters and the corresponding roller holder are integrally formed.

The roller holders may support the nip roller shaft so as to cover a part of the nip roller shaft from both ends of the nip roller shaft toward a center part in the axial direction of the nip roller shaft.

In the label printer according to a second aspect of the present invention, the roller holders may support the nip roller shaft so as to cover the nip roller shaft from both ends of the nip roller shaft toward a center part in the axial direction of the nip roller shaft to the vicinity of both ends of the nip roller.

In the label printer according to a third aspect of the present invention, the separation mechanism may be disposed in the housing.

In the label printer according to a fourth aspect of the present invention, the supporters may be made of a first resin, and the nip roller may be made of a second resin that is different from the first resin.

In the label printer according to a fifth aspect of the present invention, each of the roller holders may have a thick portion that is disposed along an elongation direction of the nip roller shaft.

In the label printer according to a sixth aspect of the present invention, the thick portion may protrude toward an opposite direction from the separation bar when printing on the print medium in a separation ejection mode.

Advantageous Effects

According to the present invention, the supporters and the roller holders that form a part of the separation mechanism are integrally formed, thereby enhancing mechanical strength of the supporters.

DESCRIPTION OF EMBODIMENTS

Figure 1:
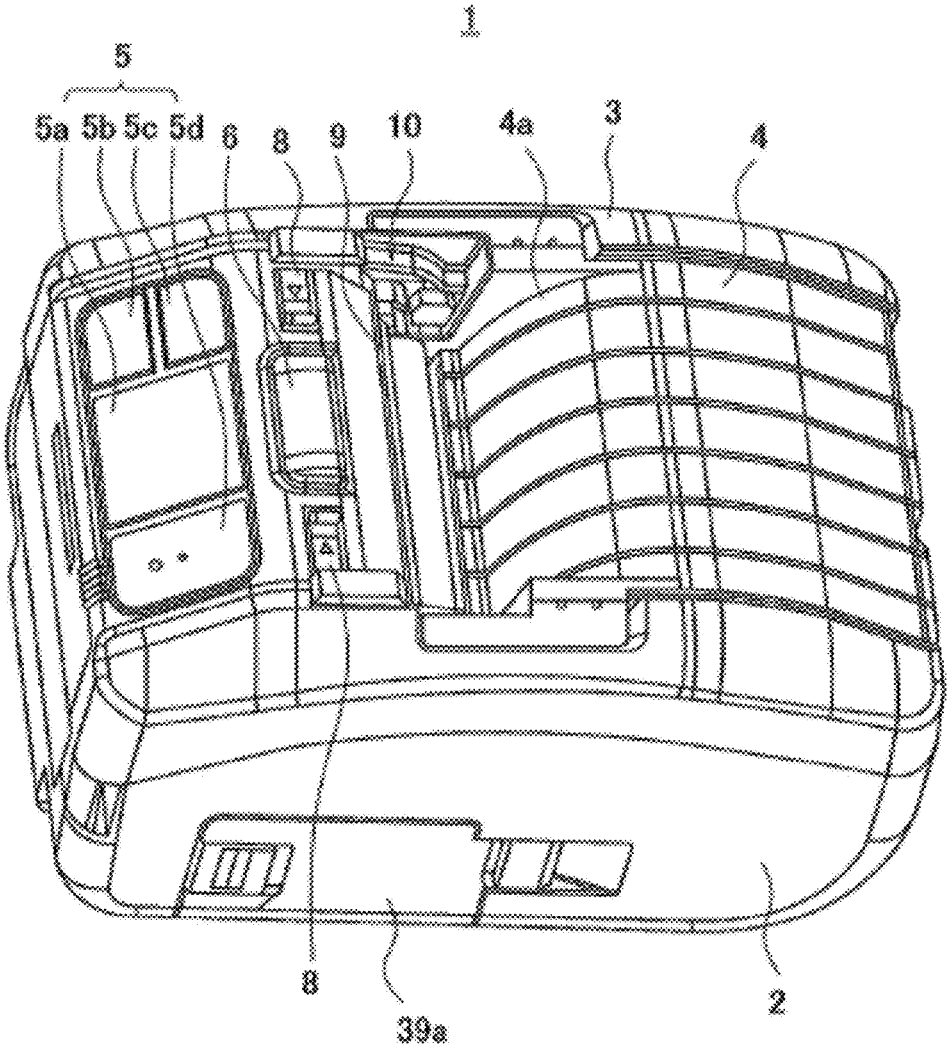
FIG. 1 is an overall perspective view of a label printer according to one embodiment of the present invention in the normal ejection state.

The present invention relates to Japanese Patent Application No. 2014-130331 filed on Jun. 25, 2014 and Japanese Patent Application No. 2014-241437 filed on Nov. 28, 2014, the entire contents of which are incorporated herein by reference.

The following describes one embodiment of the present invention in details, with reference to the drawings. In the drawings to describe the embodiment, the same reference numerals are basically assigned to the corresponding elements, and the repeated descriptions thereon are omitted.

Figure 2:
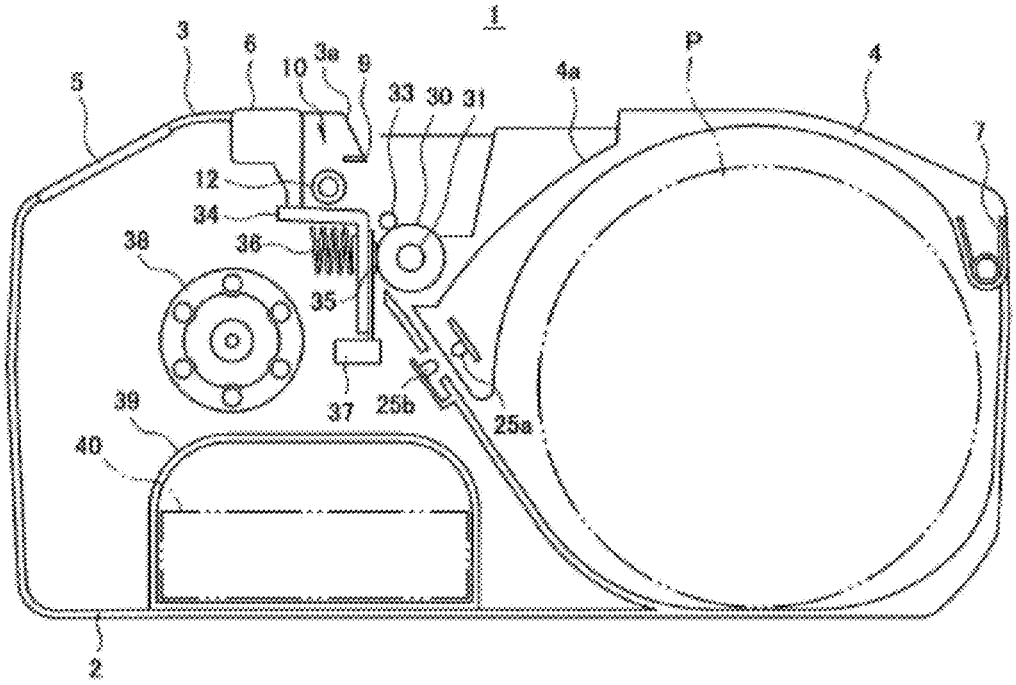
FIG. 2 schematically shows the configuration of a major part of the label printer shown in FIG. 1.
Figure 3:
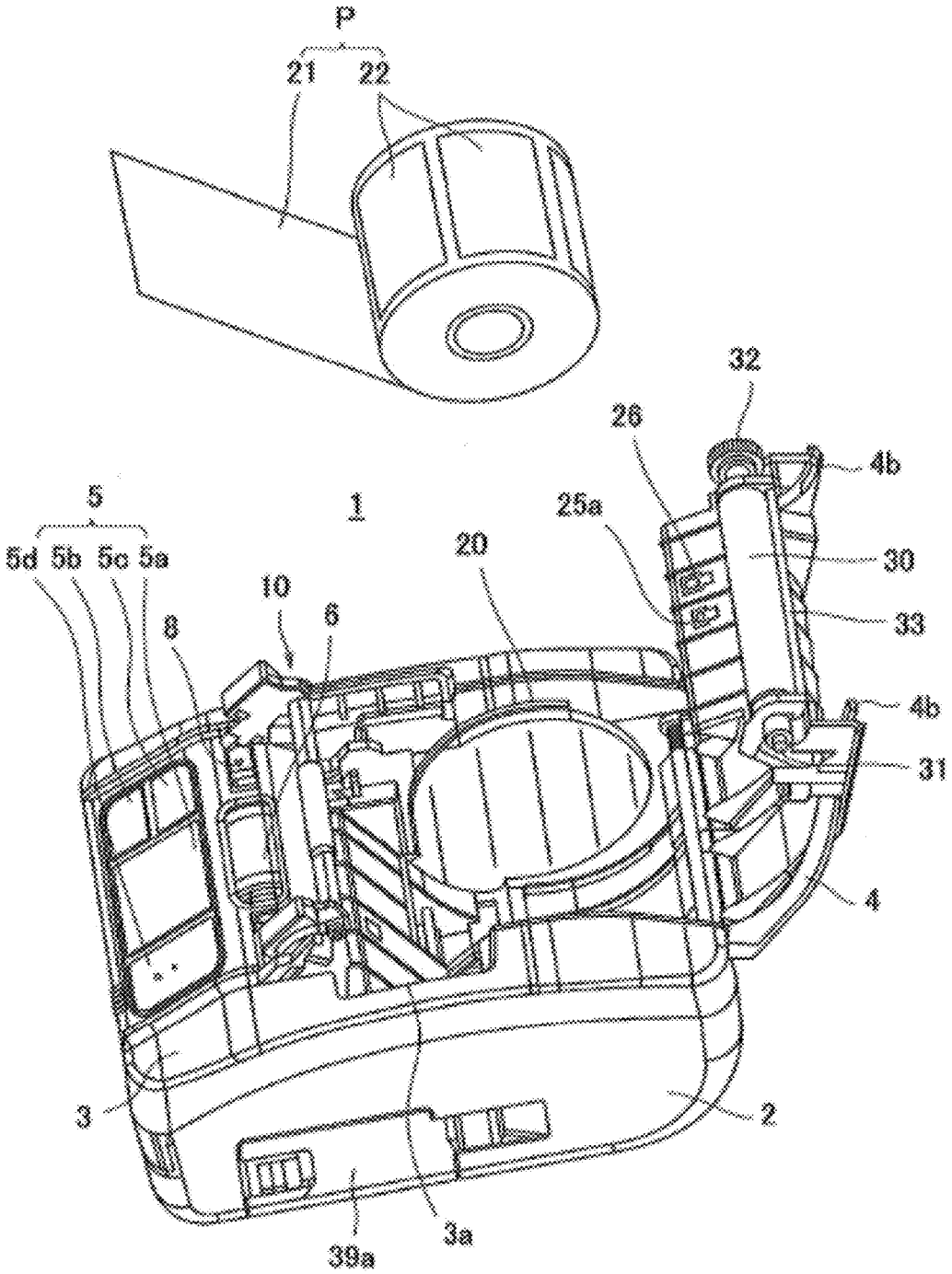
FIG. 3 is a perspective view of the label printer shown in FIG. 1 when its opening and closing cover is open, and a label continuous body.
Figure 4:
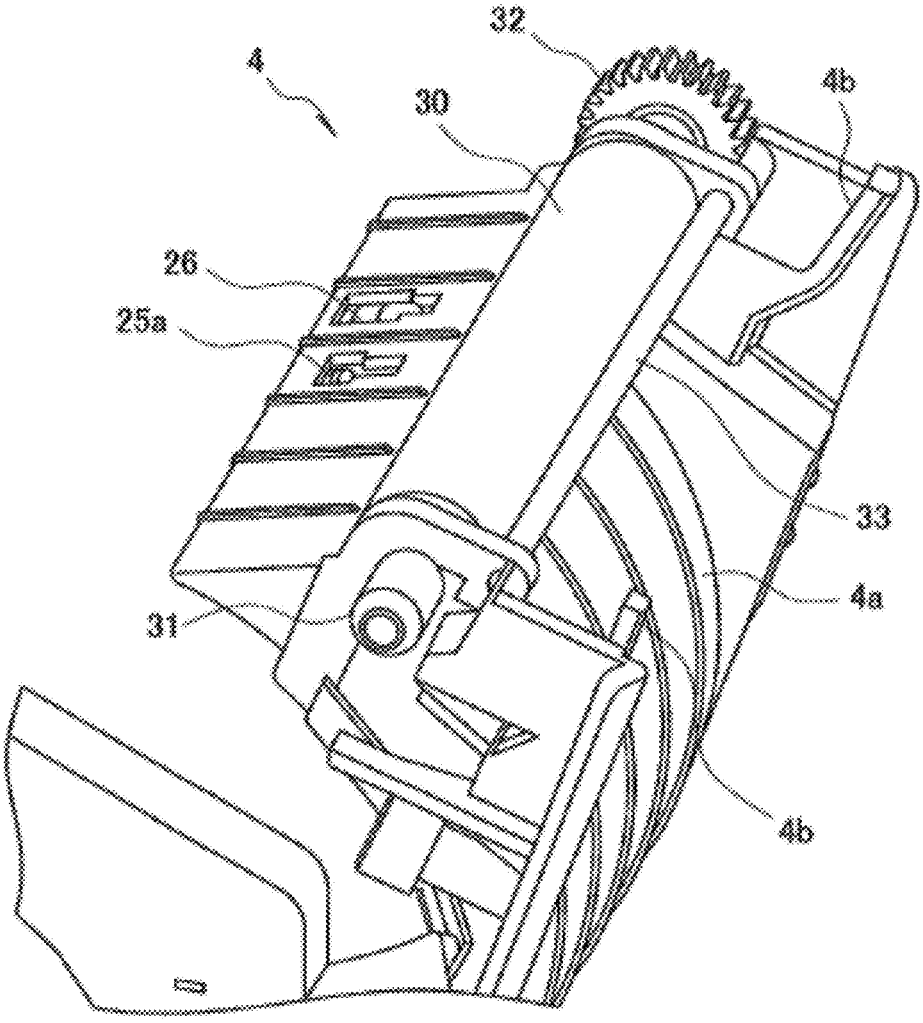
FIG. 4 is an enlarged perspective view of a tip of the opening and closing cover shown in FIG. 3.
Figure 5:
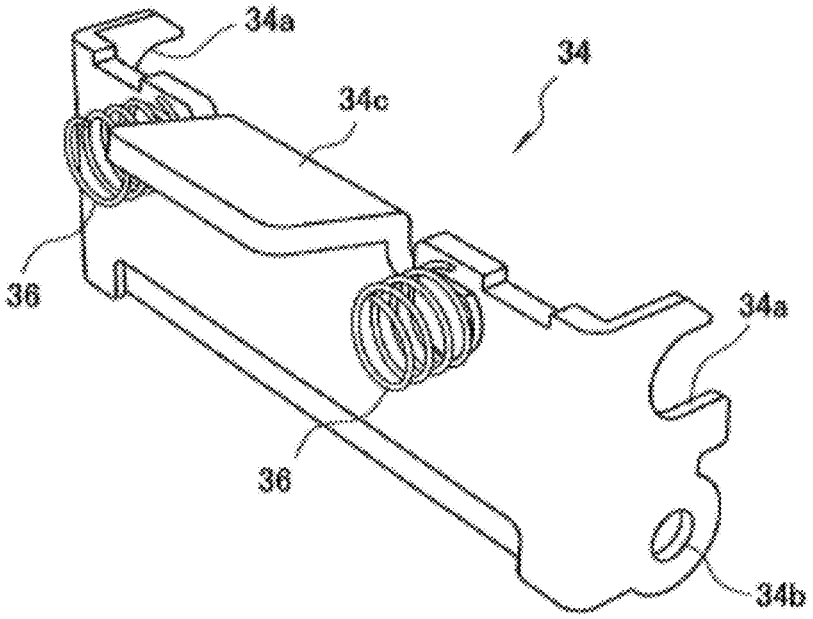
FIG. 5 is a perspective view of a head bracket to be attached to the label printer.
Figure 6:
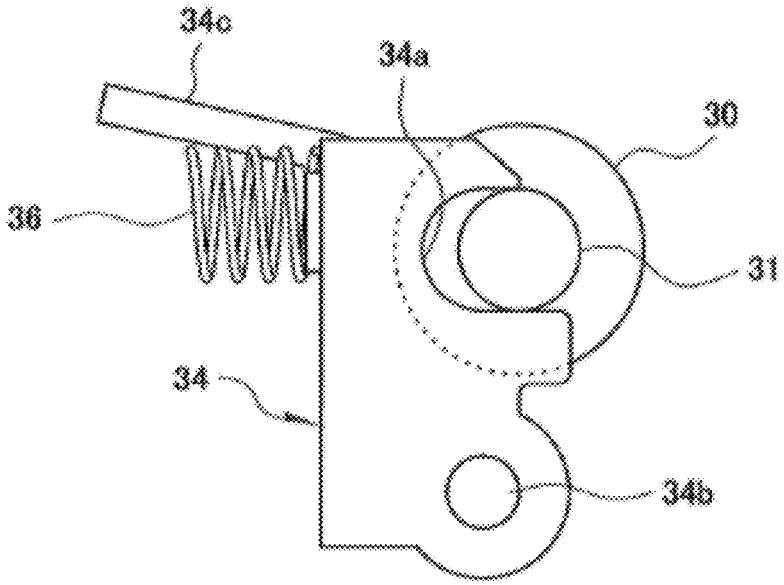
FIG. 6 explains the engagement between the head bracket shown in FIG. 5 and a platen roller.

FIG. 1 is an overall perspective view of a label printer according to the present embodiment in the normal ejection state. FIG. 2 schematically shows the configuration of a major part of this label printer. FIG. 3 is a perspective view of this label printer when its opening and closing cover is open, and a label continuous body. FIG. 4 is an enlarged perspective view of the tip of the opening and closing cover shown in FIG. 3. FIG. 5 is a perspective view of a head bracket. FIG. 6 explains the engagement between the head bracket and a platen roller.

A label printer 1 of the present embodiment is a portable label printer capable of normal-ejection mode (continuous-ejection mode) printing and separation-ejection mode printing. The label printer 1 includes a body case (a housing) 2, a front cover 3 that covers the upper face of this body case 2, and an opening and closing cover 4 that is attached openably and closably to the upper face of the body case 2.

The rear end part (see the right end part in FIGS. 1 to 3) of the opening and closing cover 4 is supported at the body case 2 with a hinge mechanism, and the opening and closing cover 4 rotates so as to be away from and closer to the body case 2. The opening and closing cover 4 is biased to be away from the body case 2 by elasticity of a torsional spring 7 that is attached to the rear end part of the opening and closing cover 4.

The front cover 3 is fixed to the body case 2 so as to cover the front face (that is, on the left of FIGS. 1 to 3) of the body case 2 other than an opening 3*a* and cover both of the lateral faces. The opening and closing cover 4 is set to the opening 3*a*. When the operator presses the opening and closing cover 4 into the body case 2 through the opening 3*a*, the opening and closing cover 4 engages with the body case 2 for closing by a mechanism described later.

On a part of the front cover 3 that is on the front side of the opening 3*a*, an operating panel 5, a cover-open button 6, a pair of cancellation levers 8, 8 and a cutter 9 are disposed.

As shown in FIG. 1, the operating panel 5 includes an LCD (Liquid Crystal Display) 5*a*, operation buttons 5*b*, 5*c*, and a power-supply button 5*d*. The LCD 5*a* is to display operation commands and various messages. The operation buttons 5*b*, 5*c* are configured to manipulate the operation of the label printer 1. The power-supply button 5*d* is configured to turn the power supply of the label printer 1 on or off.

The cover-open button 6 is configured to open the opening and closing cover 4. As shown in FIG. 2, the lower end part of the cover-open button 6 is adjacent to a head bracket (opening and closing cover supporting mechanism) 34 in the body case 2. With this configuration, when the operator presses this cover-open button 6, the head bracket 34 rotates so as to cancel the engagement between the opening and closing cover 4 and the head bracket 34 by a mechanism described later. As a result, the opening and closing cover 4 is opened.

The cancellation levers 8, 8 are configured to fix a separation unit (one example of a separation mechanism) 10, which is disposed in the vicinity of these levers, at the position of the normal ejection. When the operator slides these levers so as to be closer to each other (so as to be closer to the cover-open button 6), the engagement between the separation unit 10 and the cancellation levers 8, 8 is canceled. Though FIG. 2 shows a nip roller 12 only of the components making up the separation unit 10, the specific configuration of the separation unit 10 will be described later.

The cutter 9 is configured to cut mount 21 (see FIG. 3) of the label continuous body (one example of a print medium) P after printing during the normal ejection. The cutter 9 is disposed at a position opposed to the tip of the opening and closing cover 4. A gap between the front cover 3 with this cutter 9 attached thereto and the tip of the opening and closing cover 4 defines an outlet. Through this outlet, the label continuous body P after printing is ejected to the outside. During the separation ejection, the separation unit 10 separates a label 22 from the mount 21, and such a label 22 is only ejected from the outlet. The mount 21, which is now unnecessary, is then ejected to the outside through an ejection guide 4*a* of the opening and closing cover 4 shown in FIGS. 1 and 2.

A paper container is formed in the body case 2 to contain the label continuous body P. A paper guide 20 is attached to each of the both lateral faces of this paper container. Each paper guide 20 has a disk shape (Please note that the paper guides 20 is visible in FIG. 3.). The paper guides 20, 20 are configured to come in contact with both end faces of the label continuous body P in the axial direction when the label continuous body P is loaded in the paper container, and to support the label continuous body P rotatably. The paper guides 20, 20 are configured to guide the feeding of the label continuous body P. These paper guides 20, 20 involve a rack-and-pinion mechanism (not illustrated), and slide in the width direction of the label continuous body P so as to change their positions in accordance with the width of the label continuous body P.

As shown in FIG. 3, the label continuous body P has a long strip of mount 21 and a plurality of labels 22 temporarily adhering to the surface (label attaching face) of the mount with a predetermined interval. The label continuous body P which is wound into a roll is contained in the paper container of the body case 2. On the rear face of the mount 21, location detection marks (not illustrated) to detect the positions of the labels 22 are formed with a predetermined interval. The label attaching face of the mount 21 is coated with a separation agent, such as silicone, so as to facilitate the separation of the labels 22. Each of the labels 22 is a thermal label having a surface (printing surface) coated with a thermosensitive color developing layer that develops a color when the temperature reaches a predetermined range.

A printing part is disposed in a region adjacent to the paper container in the body case 2. The printing part is configured to print on the label continuous body P released from the paper container. As shown in FIG. 2, the printing part includes a platen roller (one example of a feed roller) 30, a separation bar 33, a head bracket 34, a thermal head (one example of a print head) 35, a coil spring 36 and the like.

Among these members of the printing part, the head bracket 34, the thermal head 35 and the coil spring 36 are attached to the body case 2, while the platen roller 30 and the separation bar 33 are attached to the tip of the opening and closing cover 4.

The platen roller 30 is feeding means of the label continuous body P. This platen roller 30 is supported at the opening and closing cover 4 so that the roller can rotate in the forward direction and the reverse direction via a platen roller shaft 31. The separation bar 33 is configured to mechanically separate the labels 22 after printing from the mount 21 of the label continuous body P when the label printer 1 prints in the separation ejection mode, and The separation bar 33 is disposed in the vicinity of the platen roller 30 so that both ends of the separation bar 33 are pivotally supported at the opening and closing cover 4.

The head bracket 34 is attached to the body case 2, and is configured to keep the opening and closing cover 4 closed. As shown in FIG. 2, when the opening and closing cover 4 is closed, the head bracket 34 is disposed at a position opposed to the platen roller 30.

As shown in FIG. 5, the head bracket 34 has grooves 34*a*, a rotary shaft 34*b* and a press lever 34*c*. The head bracket 34 is always biased so as to be closer to the platen roller 30 by the elasticity of the coil spring 36, and is attached to the body case 2 rotatably about the rotary shaft 34*b*.

When the operator sets the opening and closing cover 4 to the body case 2, as shown in FIG. 6, the platen roller shaft 31 of the platen roller 30 is fitted into the grooves 34*a*, thereby keeping the opening and closing cover 4 closed. When the operator presses down the cover-open button 6 shown in FIG. 2, the lower end part of the button presses down the press lever 34*c* of the head bracket 34, and the head bracket 34 then rotates about the rotary shaft 34*b*. As a result, the platen roller 30 is detached from the grooves 34*a*. This can cancel the engagement between the platen roller 30 and the head bracket 34, thereby opening that the opening and closing cover 4.

The thermal head 35 of the printing part is configured to print information such as letters, symbols, graphics, or barcodes on the label continuous body P. As shown in FIG. 2, the thermal head 35 is mounted on a circuit board 37 to transmit print signals, and is attached to the head bracket 34. The thermal head 35 is disposed so that its print face is opposed to the platen roller 30 when the opening and closing cover 4 is closed. During printing by the label printer 1 in both of the normal ejection mode and the separation ejection mode, the label continuous body P is released from the paper container, and then is fed while being pinched between the print face of the thermal head 35 and the platen roller 30. On the print face of the thermal head 35, a plurality of heating resistors (heating elements, not illustrated) that generate heat when current is applied thereto are disposed.

As shown in FIGS. 3 and 4, a pair of unit holders 4*b*, 4*b* is disposed at the tip of the opening and closing cover 4 and in the vicinity of the platen roller 30. The unit holders 4*b*, 4*b* are provided to fix the separation unit 10 at the separation ejection position during the separation ejection. The unit holders 4*b*, 4*b* are integrally formed with the opening and closing cover 4 and are disposed in the vicinity of the ends of the separation bar 33.

At the tip of the opening and closing cover 4 and below the platen roller 30, a light-emitting device 25*a* and a reflective sensor 26 are attached. A light-receiving device 25*b* (see FIG. 2) is attached to a location opposed to the light-emitting device 25*a* inside the body case 2. The light-emitting device 25*a* and the light-receiving device 25*b* form a transmissive sensor.

This transmissive sensor is configured to apply light from the light-emitting device 25*a* to a gap between the light-emitting device 25*a* and the light-receiving device 25*b* (that is, a feeding path of the label continuous body P fed from the paper container) and detect the light transmitting through the label continuous body P traveling along this feeding path by the light-receiving device 25*b*, so as to detect the label position or the like of the label continuous body P. The reflective sensor 26 is configured to detect whether the label continuous body P travels or not along the feeding path as described above, for example.

As shown in FIGS. 3 and 4, a gear 32 is connected to one end of the platen roller shaft 31. As shown in FIG. 2, the body case 2 internally includes a stepping motor 38 that is driving means of the platen roller 30. When the opening and closing cover 4 is set to the body case 2, the gear 32 of the platen roller shaft 31 is joined to the stepping motor 38 via other gears, a timing belt or the like, so as to transmit the rotation of the stepping motor 38 to the platen roller shaft 31.

As shown in FIG. 2, a battery case 39 is disposed at a lower part of the body case 2. This battery case 39 internally stores a battery 40 detachably. The battery 40 may be a lithium-ion secondary battery as a power supply to drive the label printer 1. As shown in FIG. 1, a battery cover 39*a* is attached to one lateral face of the body case 2 so as to cover a battery inlet of the battery case 39.

A control part, which is not illustrated, is disposed below the operating panel 5 inside the body case 2 shown in FIG. 2. The control part is configured to control print timing based on the information detected by the sensors as described above (namely, the transmissive sensor and the reflective sensor 26). During printing, heat is selectively generated at the heating resistors of the thermal head 35 in accordance with the print signals transmitted to the thermal head 35 of the printing part from the control part, whereby desired information is printed on the labels 22 of the label continuous body P shown in FIG. 3.

The label printer 1 of the present embodiment may be used transversely with the opening 3*a* of the front cover 3 directed upward (as shown in FIGS. 1 to 3). The label printer 1 may be also used vertically with a belt hook attached to the bottom of the body case 2 by hanging the belt hook from a belt of the operator standing during the operation.

Figure 7:
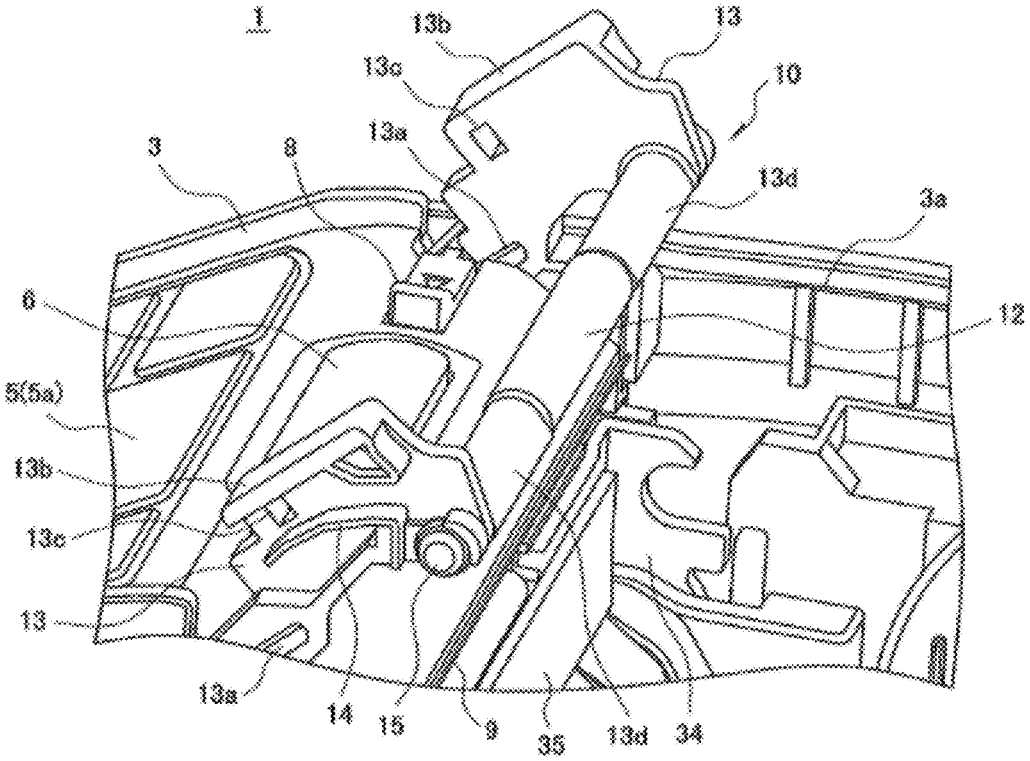
FIG. 7 is a perspective view of a separation unit attached to the label printer.
Figure 8:
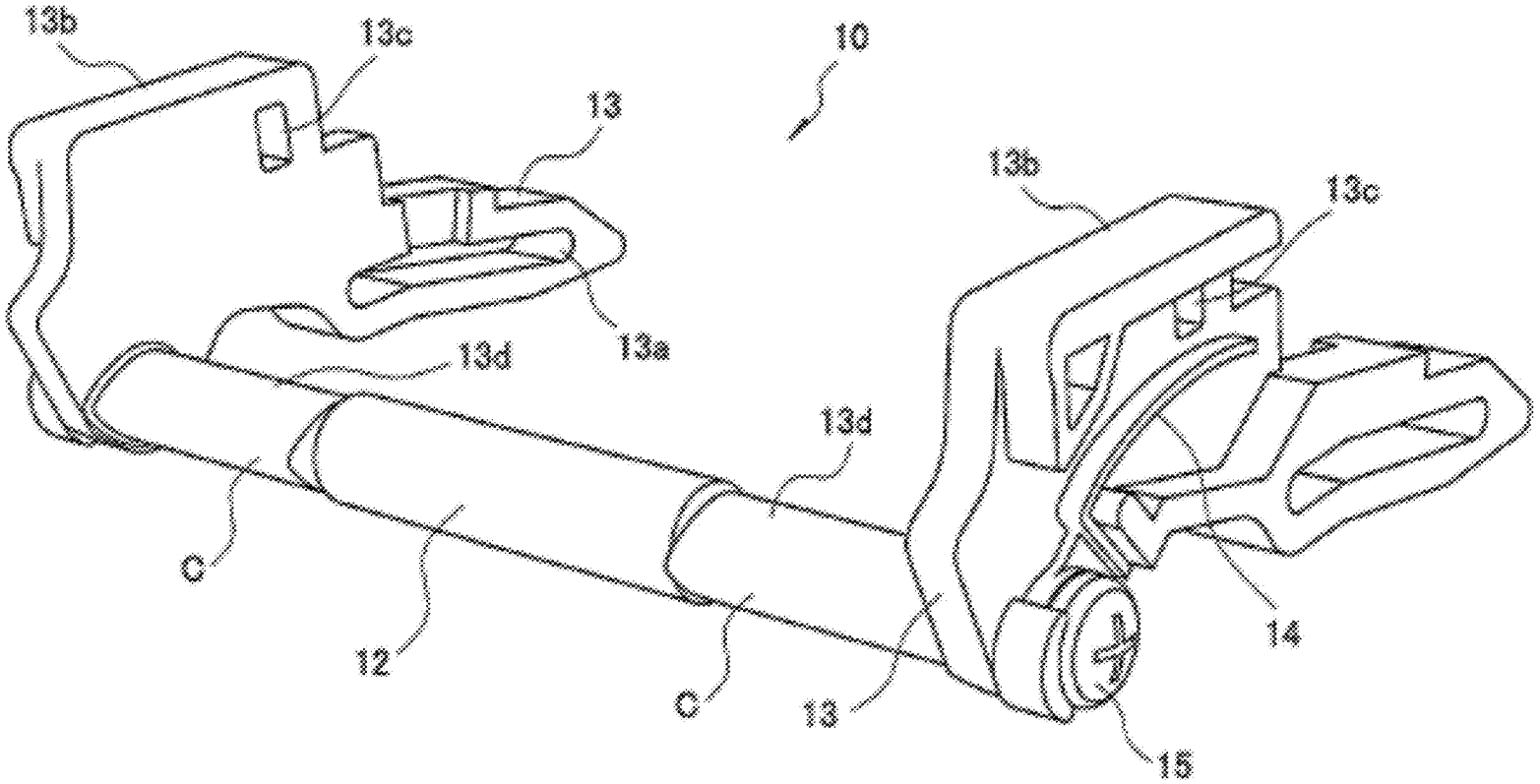
FIG. 8 is an overall perspective view of the separation unit detached from the label printer.
Figure 9:
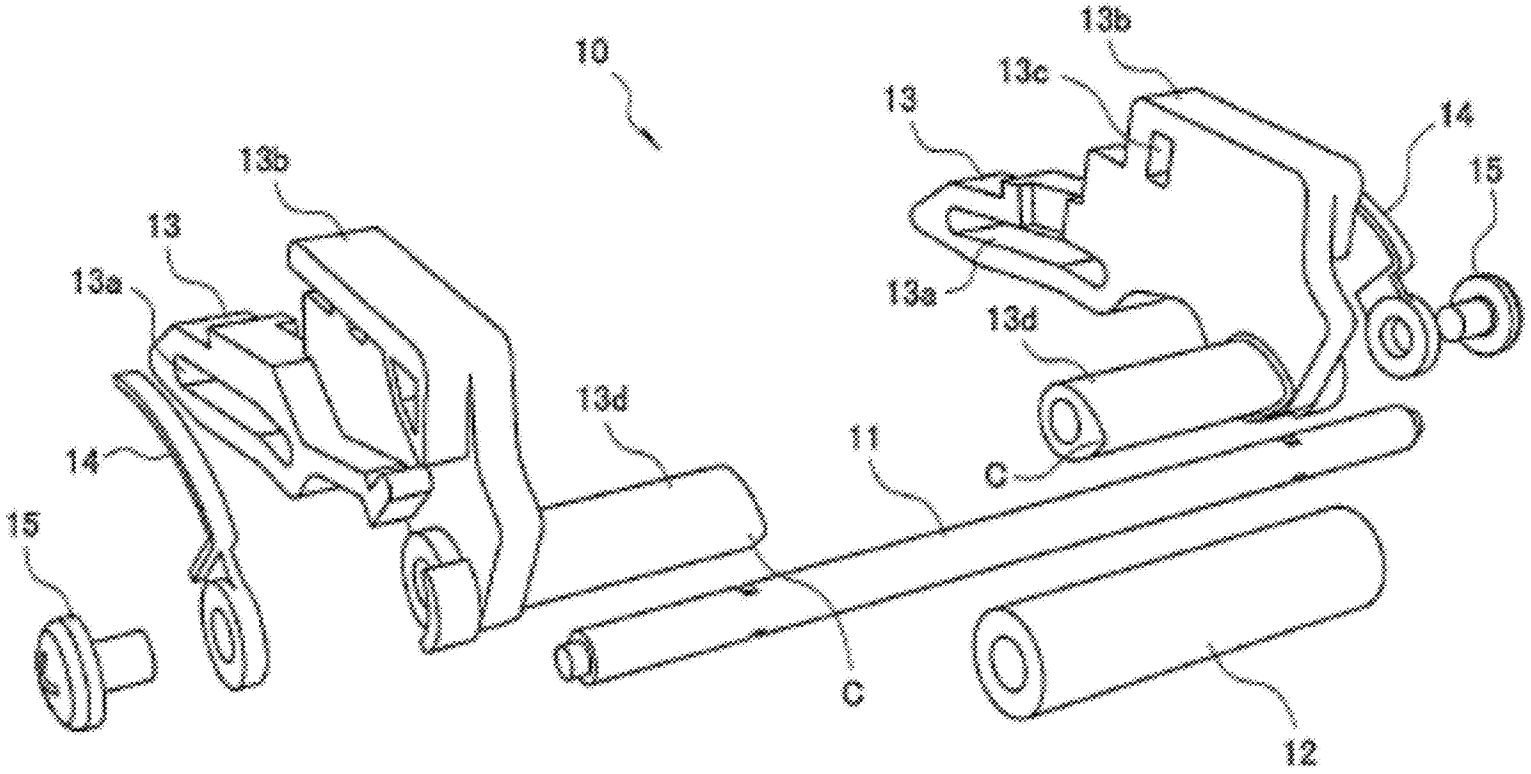
FIG. 9 is an exploded perspective view of the separation unit shown in FIG. 8.
Figure 10:
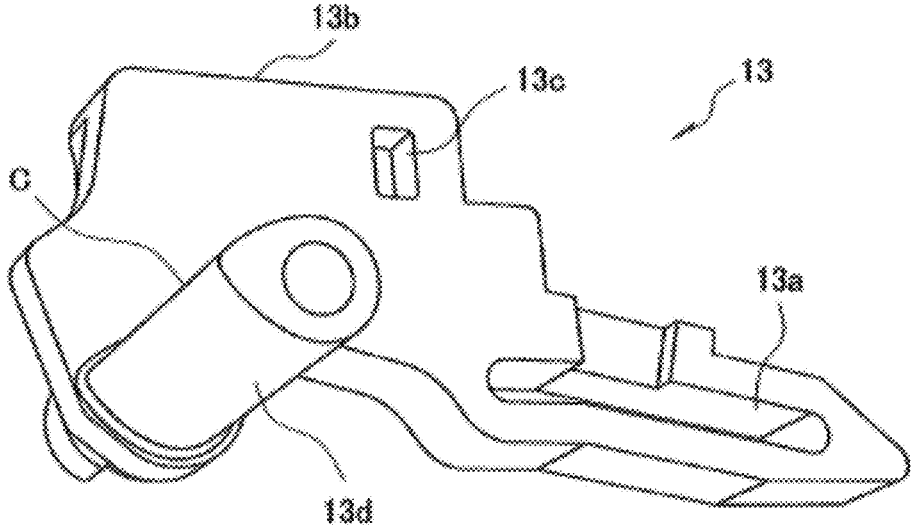
FIG. 10 is an enlarged perspective view of the supporter of the separation unit.
Figure 11:
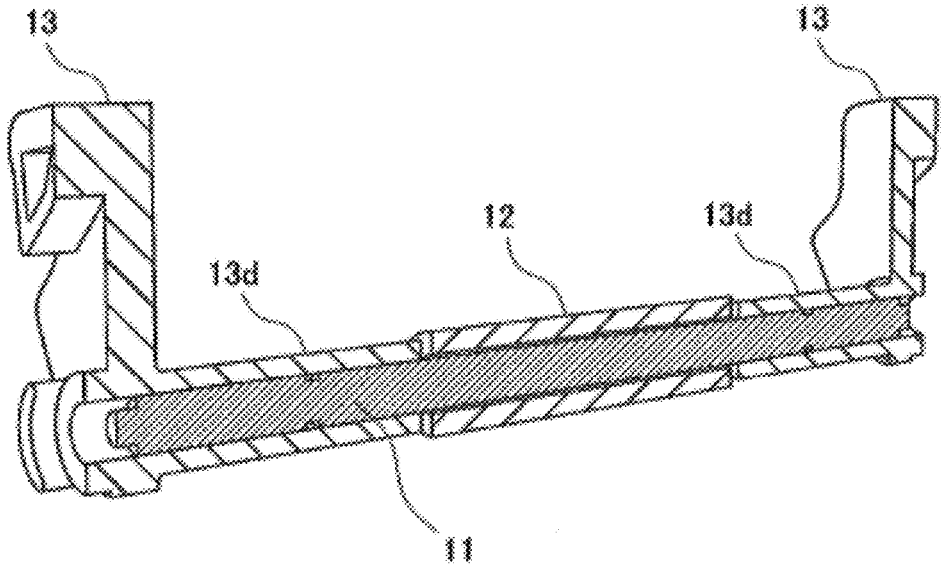
FIG. 11 is a cross-sectional view of the supporters of the separation unit along the nip roller shaft.

Referring now to FIGS. 7 to 11, the configuration of the separation unit 10 will be described below. FIG. 7 is a perspective view of the separation unit 10 attached to the label printer 1. FIG. 8 is an overall perspective view of the separation unit 10 detached from the label printer 1. FIG. 9 is an exploded perspective view of the separation unit 10. FIG. 10 is an enlarged perspective view of the supporter of the separation unit 10. FIG. 11 is a cross-sectional view of the supporters of the separation unit 10 along the nip roller shaft.

The separation unit 10 includes a metal nip roller shaft 11, a resin nip roller 12, and resin supporters 13, 13. The nip roller 12 is disposed at a center part of the nip roller shaft 11, and is pivotally supported so as to be rotatable around the nip roller shaft 11. The supporters 13, 13 support both ends of the nip roller shaft 11. The separation unit 10 is attached to the body case 2 to be relatively movable between the normal ejection position and the separation ejection position.

When the label printer 1 prints in the separation ejection mode, the nip roller 12 is disposed adjacent to the platen roller 30, and is configured to separate the labels 22 after printing from the mount 21 of the label continuous body P in cooperation with the separation bar 33 (see FIGS. 2 to 4) disposed in the vicinity of the platen roller 30. The nip roller 12 is retracted to the position away from the platen roller 30 (diagonally above the platen roller 30) during the normal ejection (see FIG. 2).

Each of the pair of supporters 13, 13 supporting the nip roller 12 has an elongated guide rail hole 13*a* at one end in the longitudinal direction. The guide rail hole 13*a* is configured to guide the movement of the separation unit 10 in the body case 2 and to restrict the moving range of the separation unit 10. Each of the pair of supporters 13, 13 has a lever 13*b* that is integrally formed at the other end, and the lever 13*b* has a flat upper face. The operator manipulates these levers 13*b* with his or her fingers so as to move the separation unit 10.

Each of the pair of supporters 13, 13 has a rectangular locking hole 13*c* in the vicinity of the lever 13*b*. This locking hole 13*c* is intended to insert one end of the cancellation lever 8 (see FIGS. 1 to 3) of the front cover 3. That is, when the operator slides the cancellation levers 8, 8 so that one ends of the cancellation levers are inserted into the locking holes 13*c*, the movement of the separation unit 10 is restricted so as to hold the separation unit 10 at the normal ejection position. When the operator slides the cancellation levers 8 in the opposite direction, the engagement between the cancellation levers 8 and the locking holes 13*c* is canceled, and the separation unit 10 can move.

Each of the pair of supporters 13, 13 has a roller holder 13*d* protruding toward the nip roller 12. These roller holders 13*d* are provided to insert ends of the nip roller shaft 11. In the label printer 1 of the present embodiment, the roller holder 13*d* inserting the end of the nip roller shaft 11 and the supporter 13 are integrally formed with synthetic resin.

Figure 12:
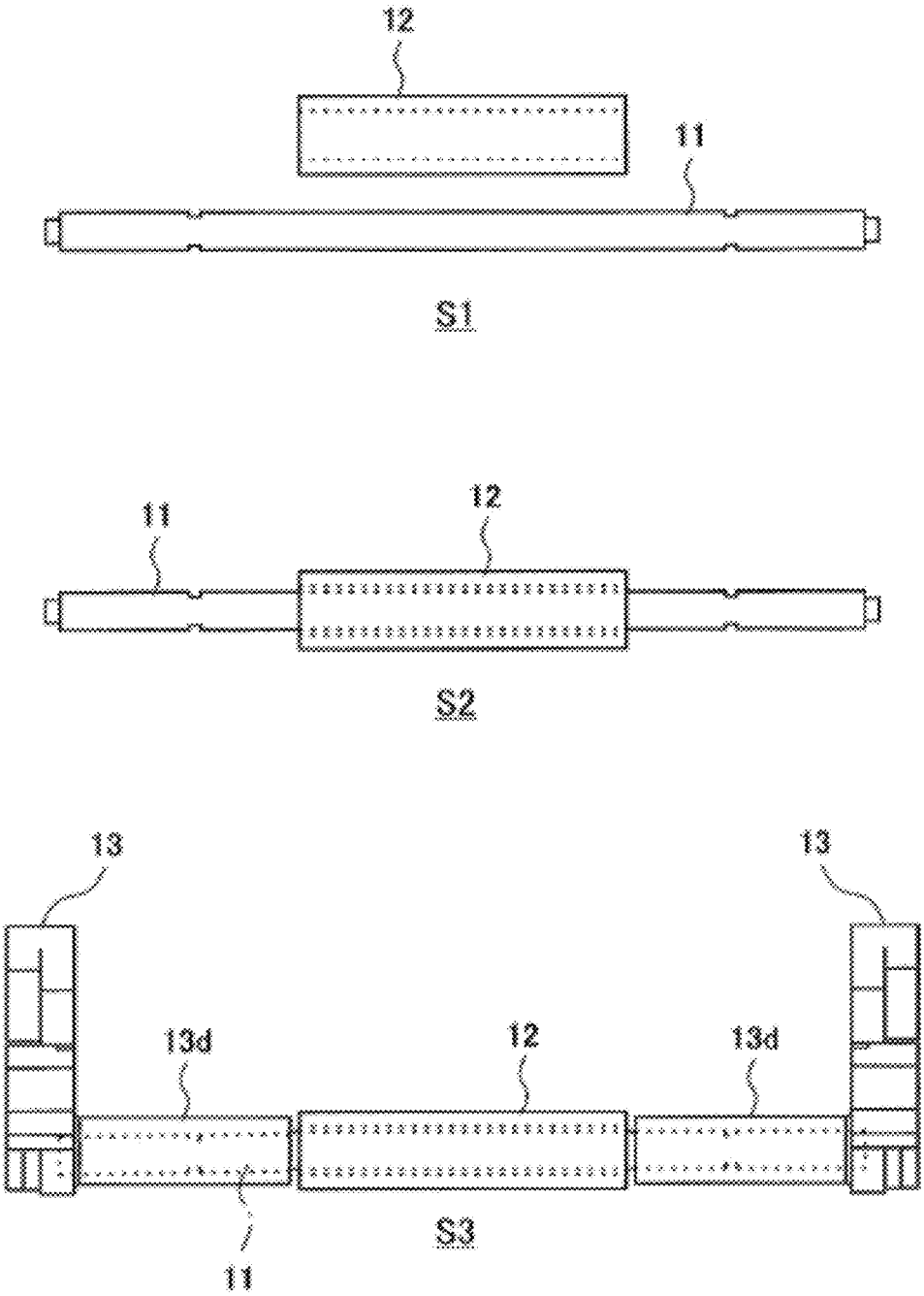
FIG. 12 explains one example of a method for integrally forming of the roller holders and the supporters of the separation unit with synthetic resin.

The roller holder 13*d* and the supporter 13 are integrally formed with synthetic resin in the following method. Firstly as shown in step S1 of FIG. 12, the cylindrical tubular nip roller 12 is prepared by resin molding, and the cylindrical nip roller shaft 11 that is a metal rod is prepared. Next, as shown in step S2 of FIG. 12, the nip roller shaft 11 is inserted into the nip roller 12. Next, the nip roller 12 and the nip roller shaft 11 in this state are mounted on a mold (not illustrated). As shown in step S3 of FIG. 12, the ends of the nip roller shaft 11 are inserted into the roller holders 13*d*, and the roller holders 13*d* and the supporters 13, 13 are then integrally formed. Thereby, the roller holders 13*d*, which is integrally formed with the supporters 13, support the nip roller shaft 11 so as to cover the both ends of the nip roller shaft 11. The roller holders 13*d* support the nip roller shaft 11 so as to cover the nip roller shaft 11 from both ends of the nip roller shaft 11 toward a center part in the axial direction of the nip roller shaft 11 to a part in the vicinity of the both ends of the nip roller 12. More specifically, each roller holder 13*d* supports the nip roller shaft 11 so as to cover substantially one third of the length of the nip roller shaft 11. With this configuration, the nip roller shaft 11 is supported firmly by the roller holders 13*d*. Further, since the roller holders 13*d* are integrally formed with the supporters 13, the separation unit as a whole employs enhanced mechanical strength. The nip roller 12, which comes in contact with the label continuous body P, is preferably made of resin excellent in mechanical strength and resistance to fatigue, such as polyacetal resin. The roller holders 13*d* and the supporters 13 may be made of general-purpose resin, such as polycarbonate resin.

In this way, since the roller holders 13*d* and the supporters 13 are integrally formed with synthetic resin, the supporters 13 employs enhanced mechanical strength. Further since the roller holders 13*d*, which is integrally formed with the supporters 13, support the nip roller shaft 11 so as to cover both ends of the nip roller shaft 11, the separation unit 10 also employs enhanced mechanical strength. Such integral forming of the roller holders 13*d* and the supporters 13 enhance the workability during the assembly of the separation unit 10 as well.

Each of the roller holders 13*d*, 13*d*, which are integrally formed with the supporters 13, has a protrusion C (one example of a thick portion) along the elongation direction of the nip roller shaft 11. The protrusion C protrudes toward the other end in the longitudinal direction of the supporter 13 (that is, the opposite side of the guide rail hole 13*a*). In other words, the protrusion C protrudes toward the opposite direction from the separation bar 33 in the vicinity of the platen roller 30 when the separation unit 10 is at the separation ejection position.

As described above, each of the roller holders 13*d*, 13*d*, which support the nip roller shaft 11, has the protrusion C, and the protrusion C is a thick portion of the roller holders 13*d*, 13*d*. Accordingly the roller holders 13*d* employs enhanced mechanical strength. As a result, the supporters 13 and accordingly the separation unit 10 can employs more enhanced mechanical strength.

Further, each of the pair of supporters 13, 13 has a metal plate spring 14 attached thereto detachably. Each of these plate springs 14, 14 has a base end that is fixed to the other end side in the longitudinal direction (that is, the side on which the nip roller shaft 11 is attached) of the supporter 13 via a screw 15. The plate spring 14 extends in a curved line from there to one end side in the longitudinal direction (the side on which the guide rail hole 13*a* is disposed), and the tip of the plate spring 14 floats. As described later, these plate springs 14, 14 are elastic members that are brought into contact with the unit holders 4*b* (see FIGS. 3 and 4) of the opening and closing cover 4 during the separation ejection so as to bias the nip roller 12 toward the platen roller 30.

Figure 13:
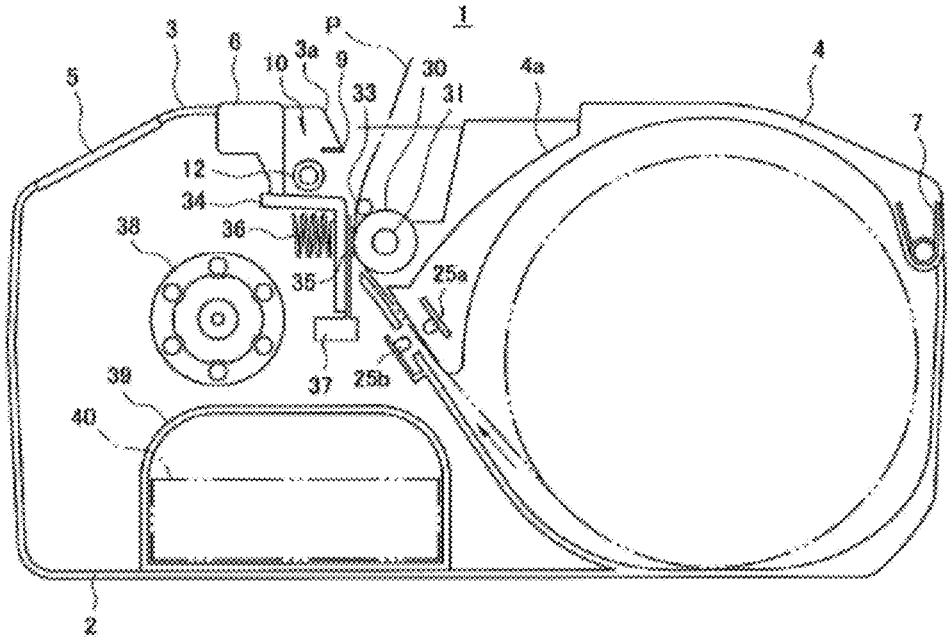
FIG. 13 schematically shows the configuration of a major part of the label printer during printing in the normal ejection mode.

Next, the printing step of the label printer 1 will be described. Firstly in case of printing in the normal ejection mode, as shown in FIG. 13, the platen roller 30 is rotated while the label continuous body P released from the paper container of the body case 2 is pinched between the thermal head 35 and the platen roller 30. Thereby printing is performed on the label continuous body P while feeding the label continuous body P. When printing ends, the label continuous body P is ejected to the outside through the gap (outlet) between the front cover 3 and the tip of the opening and closing cover 4.

In a case in which the label printer is switched from the normal ejection mode to the separation ejection mode, the engagement between the cancellation levers 8, 8 shown in FIG. 1 and the separation unit 10 is canceled by sliding these cancellation levers 8, 8 so as to be closer to each other (that is, so as to be closer to the cover-open button 6).

Figure 14:
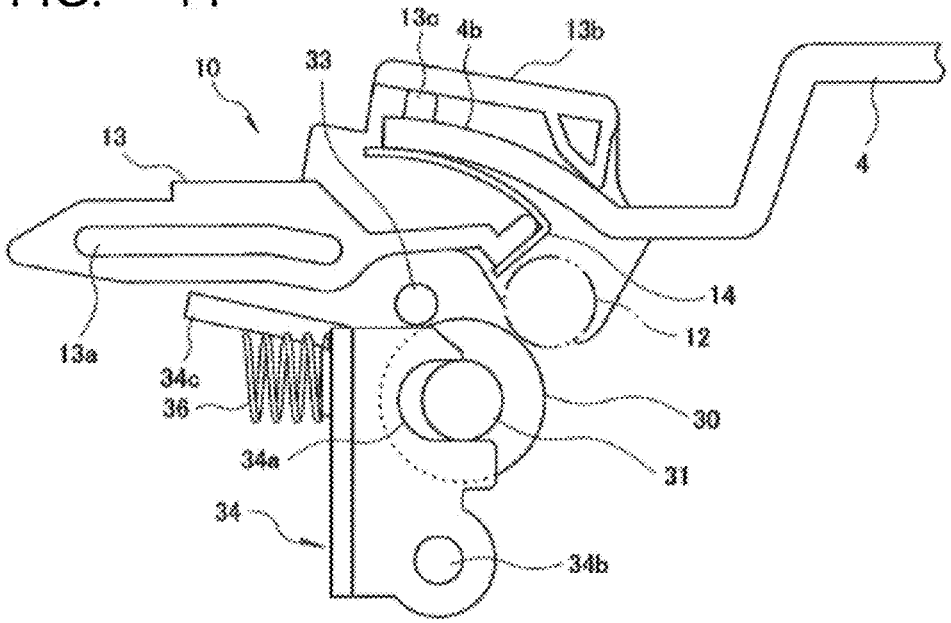
FIG. 14 explains a method for switching from the normal ejection mode to the separation ejection mode.
Figure 15:
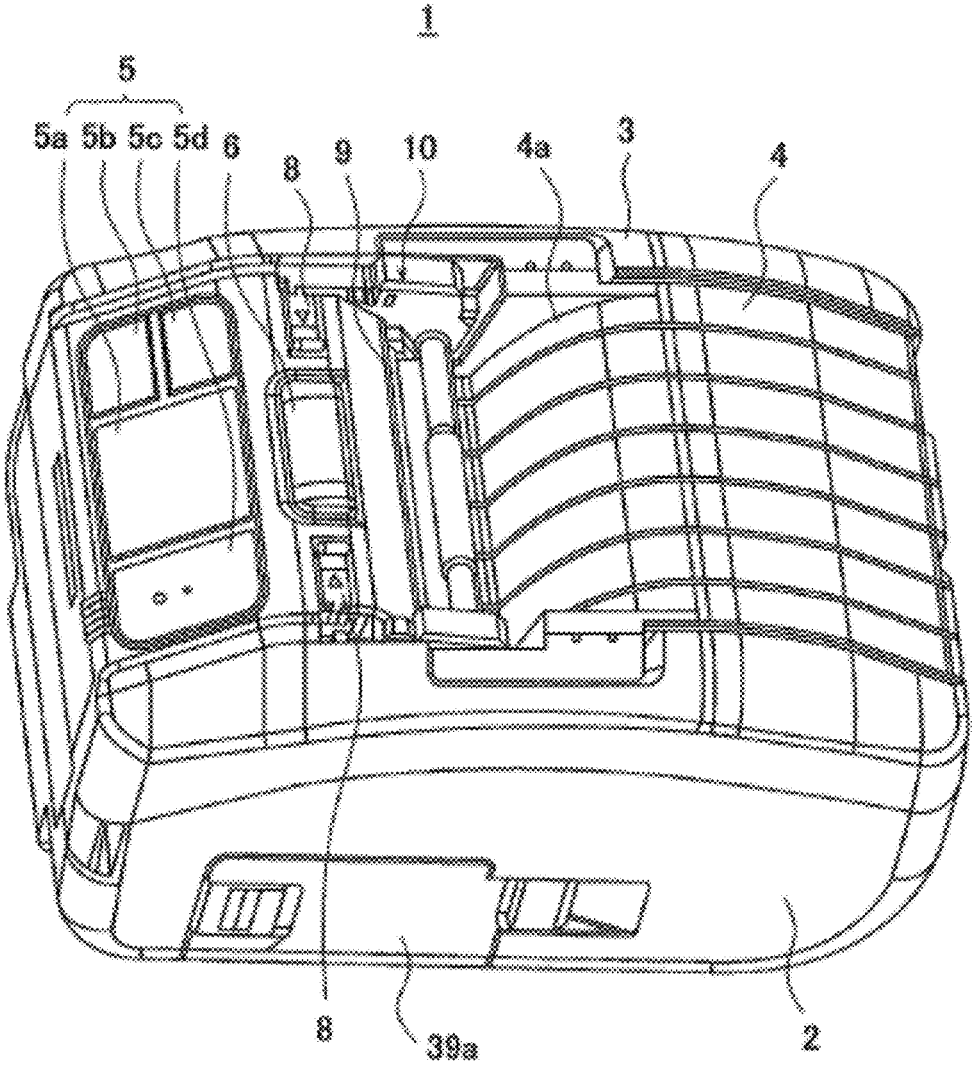
FIG. 15 is an overall perspective view of the label printer in the separation ejection mode.

Subsequently, as shown in FIG. 14, the separation unit 10 is moved toward the opening and closing cover 4 by sliding the levers 13*b* of the supporters 13 in the separation unit 10. Then, the unit holders 4*b* of the opening and closing cover 4 enter space between the levers 13*b* of the separation unit 10 and the plate springs 14, whereby the separation unit 10 is fixed to the separation ejection position, and the nip roller 12 of the separation unit 10 is biased toward the platen roller 30. FIG. 15 is an overall perspective view of the label printer 1 set in the separation ejection mode in this way.

Figure 16:
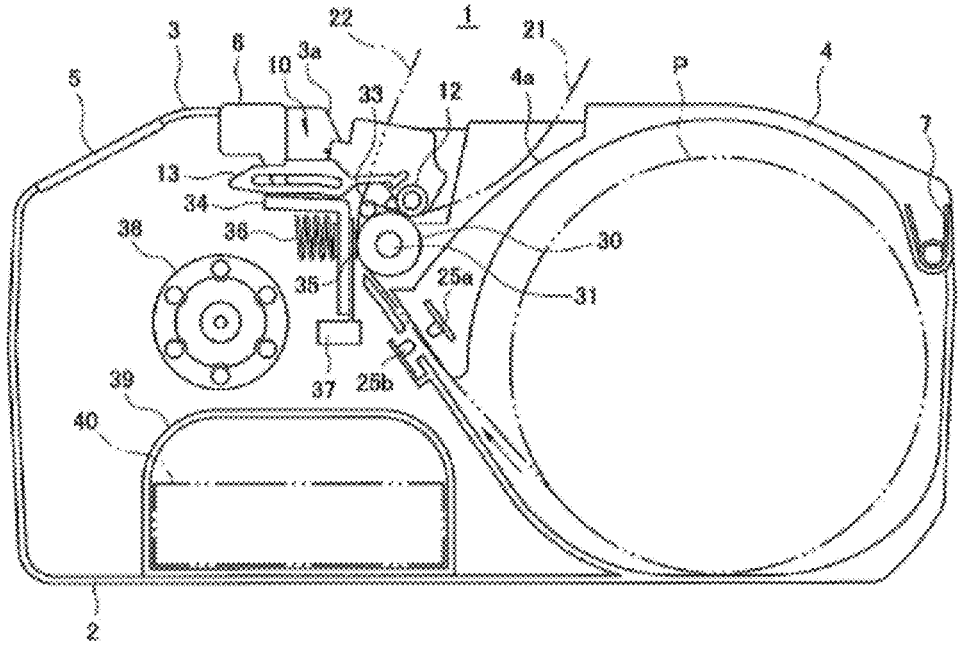
FIG. 16 schematically shows the configuration of a major part of the label printer during printing in the separation ejection mode.

Similarly to the printing in the normal ejection mode, in case of printing in the separation ejection mode, the platen roller 30 is rotated while the label continuous body P released from the paper container of the body case 2 is pinched between the thermal head 35 and the platen roller 30 as shown in FIG. 16. Thereby printing is performed on the label continuous body P while feeding the label continuous body P.

At this time, the labels 22 after printing are separated from the mount 21 one by one, and are ejected to the outside through the gap (outlet) between the front cover 3 and the tip of the opening and closing cover 4. Meanwhile, the mount 21 pinched between the nip roller 12 of the separation unit 10 and the platen roller 30 via the separation bar 33 is ejected to the outside via the ejection guide 4*a* of the opening and closing cover 4.

Figure 17:
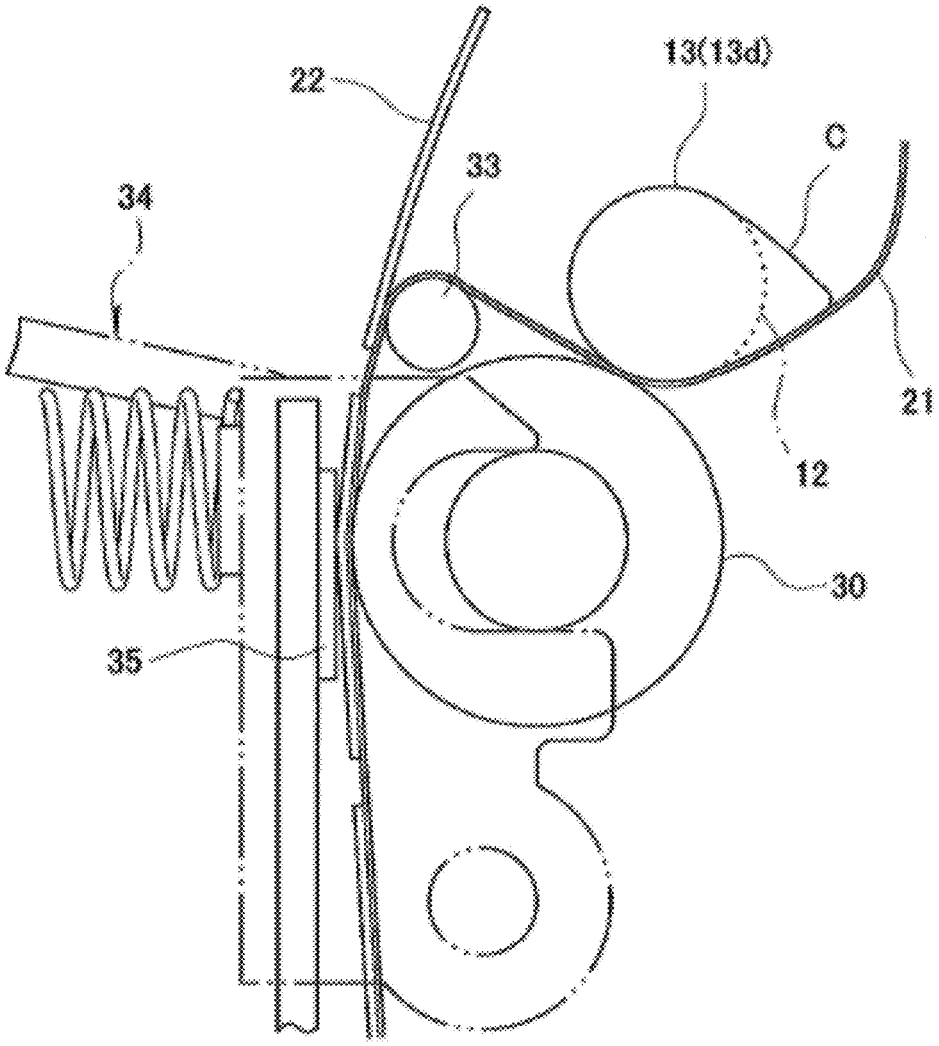
FIG. 17 is an enlarged view of the printing part during printing in the separation ejection mode.

FIG. 17 is an enlarged view of the printing part during the separation ejection. As shown in FIG. 17, during the separation ejection, the protrusion C of the roller holder 13*d*, which is integrally formed with the supporter 13 of the separation unit 10, protrudes toward the opposite direction from the separation bar 33 in the vicinity of the platen roller 30.

Thus the protrusion C of the roller holder 13*d* does not interfere with the separation and feeding of the mount 21 by the separation bar 33 and the nip roller 12. Further, the protrusion C guides the mount 21 passed between the nip roller 12 and the platen roller 30 toward the ejection port, and this can lead to advantageous effect that the mount 21 is prevented from being caught up in the separation unit 10. That is, the labels 22 can be separated favorably during printing in the separation ejection mode.

Although the specific descriptions of the invention by the present inventor have been provided by way of the embodiment, the embodiment disclosed in the specification is illustrative in all aspects and the invention should not be limited to the disclosed techniques. That is, the technical scope of the present invention should not be construed limitedly based on the descriptions on the above embodiments, but should be construed in accordance with the definitions of the claims. The present invention should cover equivalent and all modifications thereof without departing from the scope of claims.

Figure 18:
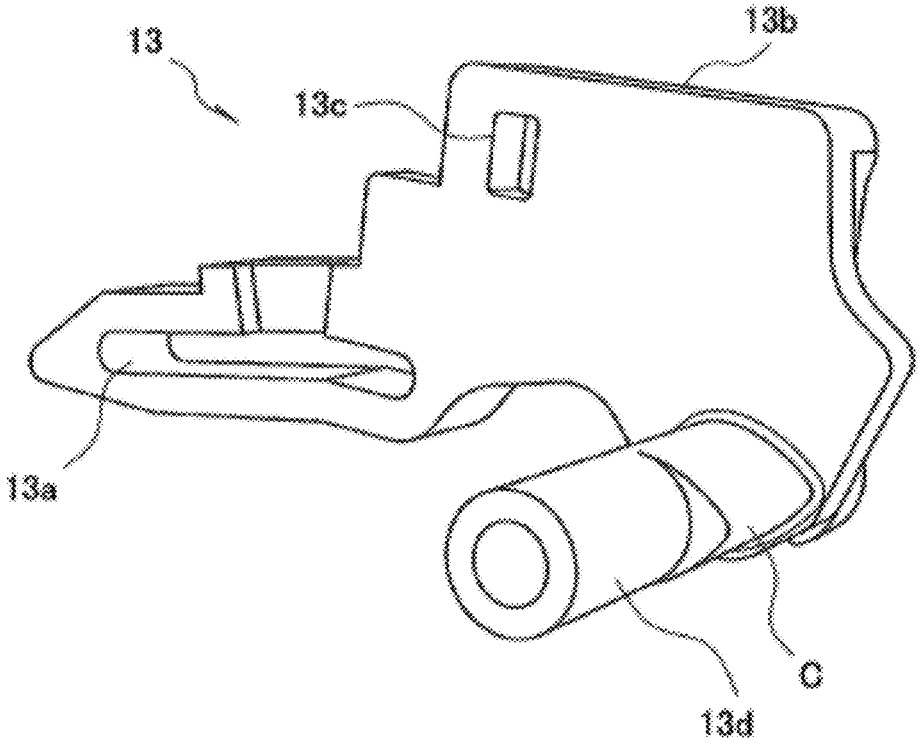
FIG. 18 is an enlarged perspective view of the supporter, showing another example of the protrusion on the roller holder.

For instance, as shown in FIG. 18, the protrusion C of the roller holder 13*d* may be disposed at a part of the roller holder 13*d* only.

For instance, although the embodiment describes a printer of a double-function type that can be used for both of the normal ejection and the separation ejection, the present invention is not limited to this specific printer. The embodiment is applicable to a printer configured to print in the separation ejection mode only.

Although the present embodiment describes the case in which a label continuous body including a plurality of labels temporarily adhering to a mount is used as a print medium, the present invention is not limited to such case. For instance, a continuous label (mountless label) having an adhesive surface on one side, a continuous sheet without an adhesive surface, or film which can be printed with a thermal head instead of paper, may be used as the print medium. The mountless label, the continuous sheet or the film may have location detection marks thereon. In order to feed a mountless label that exposes adhesive agent, the feeding path may be coated with anti-adhesive and a anti-adhesive roller containing silicone may be used.

The invention claimed is:

1. A label printer, comprising:

a housing including an opening;

an opening and closing cover attached to the housing so as to open and close the housing;

a feed roller rotatably supported on the opening and closing cover, the feed roller being configured to feed a print medium;

a separation bar supported on the opening and closing cover and disposed in the vicinity of the feed roller;

a print head disposed in the housing, the print head being disposed so as to be opposing the feed roller when the opening and closing cover is closed, the print head being configured to print on the print medium; and a separation mechanism disposed adjacent to the feed roller when printing on the print medium, wherein the separation mechanism includes:

a pair of supporters opposing each other in a direction orthogonal to a feed direction of the print medium;

a pair of roller holders each extending from an inner surface of a respective one of the pair of supporters in a direction orthogonal to the corresponding supporter, the direction being along which the pair of roller holders come closer to each other, each of the pair of roller holders being integrally formed with the corresponding supporter;

a nip roller shaft having both ends each supported by a respective one of the pair of roller holders; and a nip roller supported on the nip roller shaft so as to be rotatable.

2. The label printer according to claim 1, wherein the pair of roller holders inserts therein the both ends of the nip roller shaft and supports the nip roller shaft so as to cover the both ends of the nip roller shaft.

3. The label printer according to claim 1, wherein the pair of roller holders supports the nip roller shaft so as to cover the nip roller shaft from both ends of the nip roller shaft toward a center part in the axial direction of the nip roller shaft to the both ends of the nip roller.

4. The label printer according to claim 1, wherein the separation mechanism is disposed in the housing.

5. The label printer according to claim 1, wherein the supporters are made of a first resin, and the nip roller is made of a second resin, the second resin being different from the first resin.

6. The label printer according to claim 1, wherein each of the roller holders has a thick portion that is disposed along an elongation direction of the nip roller shaft.

7. The label printer according to claim 6, wherein the thick portion protrudes toward an opposite direction from the separation bar when printing on the print medium in a separation ejection mode.

8. A label printer, comprising:

a housing including an opening;

an opening and closing cover attached to the housing so as to open and close the housing;

a feed roller rotatably supported on the opening and closing cover, the feed roller being configured to feed a print medium;

a separation bar supported on the opening and closing cover and disposed in the vicinity of the feed roller;

a print head disposed in the housing, the print head being disposed so as to be opposing the feed roller when the opening and closing cover is closed, the print head being configured to print on the print medium; and a separation mechanism disposed adjacent to the feed roller when printing on the print medium, the separation mechanism including:

a pair of supporters opposing each other in a direction orthogonal to a feed direction of the print medium, a pair of roller holders each extending from a respective one of the pair of supporters in a direction orthogonal to the corresponding supporter, the direction being along which the pair of roller holders come closer to each other, each of the pair of roller holders being integrally formed with the corresponding supporter, a nip roller shaft having both ends each supported by a respective one of the pair of roller holders, and a nip roller supported on the nip roller shaft so as to be rotatable, wherein a lateral part of the pair of supporters, in sides at which the nip roller is disposed, is connected only by a portion of the nip roller shaft, the portion of the nip roller shaft being covered with the pair of roller holders.

9. The label printer according to claim 8, wherein the pair of roller holders supports the nip roller shaft so as to cover the nip roller shaft from both ends of the nip roller shaft toward a center part in an axial direction of the nip roller shaft to the vicinity of both ends of the nip roller.

10. The label printer according to claim 8, wherein substantially a whole structure of the separation mechanism is disposed in the housing.

11. The label printer according to claim 8, wherein the supporters are made of a first resin, and the nip roller is made of a second resin, the second resin being different from the first resin.

12. The label printer according to claim 8, wherein each of the roller holders has a thick portion protruding in a radial direction, the thick portion being disposed along an elongation direction of the nip roller shaft.

13. The label printer according to claim 12, wherein the thick portion protrudes toward an opposite direction from the separation bar when printing on the print medium in a separation ejection mode.

14. A label printer, comprising:

a housing including an opening;

an opening and closing cover attached to the housing so as to open and close the housing;

a feed roller rotatably supported on the opening and closing cover, the feed roller being configured to feed a print medium;

a separation bar supported on the opening and closing cover and disposed in the vicinity of the feed roller;

a print head disposed in the housing, the print head being disposed so as to be opposing the feed roller when the opening and closing cover is closed, the print head being configured to print on the print medium; and a separation mechanism disposed adjacent to the feed roller when printing on the print medium, the separation mechanism including:

a pair of supporters opposing each other in a direction orthogonal to a feed direction of the print medium, a pair of roller holders each extending from a respective one of end surfaces of the pair of supporters in only a direction orthogonal to the corresponding supporter, the direction being along which the pair of roller holders come closer to each other, the end surfaces of the pair of supporters facing each other, each of the pair of roller holders being integrally formed with the corresponding supporter, a nip roller shaft having both ends each supported by a respective one of the pair of roller holders, and a nip roller supported on the nip roller shaft so as to be rotatable, wherein the pair of roller holders inserts therein the both ends of the nip roller shaft and supports the nip roller shaft so as to cover the both ends of the nip roller shaft.

15. The label printer according to claim 14, wherein substantially a whole structure of the separation mechanism is disposed in the housing.

16. The label printer according to claim 14, wherein the supporters are made of a first resin, and the nip roller is made of a second resin, the second resin being different from the first resin.

17. The label printer according to claim 14, wherein each of the roller holders has a thick portion that is disposed along an elongation direction of the nip roller shaft.

18. The label printer according to claim 17, wherein the thick portion protrudes toward an opposite direction from the separation bar when printing on the print medium in a separation ejection mode.

* * * * *